United States Patent [19]

Lisle

[11] 4,054,000

[45] Oct. 18, 1977

[54] LAWN MARKER

[76] Inventor: Carolyn L. Lisle, 2236 Benita Drive, Rancho Cordova, Calif. 95670

[21] Appl. No.: 672,298

[22] Filed: Mar. 31, 1976

[51] Int. Cl.[2] ..... G09F 19/00; G09F 3/02

[52] U.S. Cl. ..... 40/124.5; 40/10 C; 40/10 D; 52/104; 52/105; 428/13

[58] Field of Search ..... 40/124.5, 27.5, 140, 40/10 R, 10 C, 10 D, 16; 428/13; 52/104, 105

[56] References Cited

U.S. PATENT DOCUMENTS

| | | | |
|---|---|---|---|
| 2,046,594 | 7/1936 | Walton | 40/124.5 |
| 2,511,552 | 6/1950 | Stuempges | 40/10 R X |
| 2,747,230 | 5/1956 | Magnus | 428/13 X |
| 2,917,856 | 12/1959 | Soloff | 428/13 |
| 3,312,197 | 4/1967 | Smith | 40/27.5 X |
| 3,438,159 | 4/1969 | Bergener et al. | 40/124.5 X |
| 3,953,932 | 5/1976 | Graves | 40/27.5 |

*Primary Examiner*—Edgar S. Burr
*Assistant Examiner*—William Pieprz
*Attorney, Agent, or Firm*—Mark C. Jacobs

[57] ABSTRACT

A lawn marker comprising a solid member having a smooth or rough exterior surface on four sides, solid of desired shape, translucent or transparent, clear or colored, usually rectangular of an acrylic or methacrylic polymer and having indicia indicative of or desired by the decedent embedded therein, and having a smooth front surface laminated to an acrylic or methacrylic polymer member. Carved indicia is present in either the solid or in the member.

17 Claims, 5 Drawing Figures

LAWN MARKER

Traditionally, tombstones, headstones, or the like are made of marble or granite or other natural rock. These may contain at least one polished surface, usually the surface into which the necessary inscription is engraved. Such stones are expensive, are difficult to handle, and are expensive to transport, but are not as durable as might be expected. Water freezing and thawing in cracks and crevices may cause a breaking of the stone. Such stones are prone to weathering. In moist and wet climates the stones deteriorate rapidly.

Such shortcomings are seen to exist for both the normal large traditional tombstones, and to a lesser extent, for the comparatively smaller horizontal markers.

Additionally, the engraving of such marble and granite stones is quite difficult and requires heavy duty rock cutting equipment. The same is true of the shaping and polishing of material, which generally involves large equipment with a high capital outlay and high maintenance costs of such tooling. All the shaping, polishing and engraving requires a great amount of hand labor as well as the specialized equipment. Further, considerable manhours of time are necessary to complete the headstones, inscribe them and then to set them in place. The transportation of these heavy objects necessitates generally a small and local industry, and it is thus considerably more expensive than the use of production line methods.

In these times of mass production and the de-emphasis of skilled labor, oftentimes it is not even possible to find a person capable of providing these specialized services to the satisfaction of the living party.

One alternate to the traditional headstone is the composite tablets of U.S. Pat. No. 3,857,214, which has a glass fiber-filled resin exterior and a concrete interior for body and weight. While the manufacturing and shipping problems of traditional units are overcome, they seem to suffer from a lack of esthetic appeal.

Another comparatively recent lawn marker is that of Lauer, U.S. Pat. No. 3,383,787. The horizontal system of that patent employs a tablet of metal or stone which is positioned over a concrete slab.

Neither of the above tablet systems, however, improve the esthetics of a lawn, be it for a golf course or a memorial park, and neither of these possess any indicia of a person or the surroundings.

It is therefore an object of this invention to provide a low-cost, easily manufactured lawn tablet. Another object is to provide a durable esthetic lawn tablet.

Still another object is to provide a lawn tablet or marker of a polymerized acrylate and/or methacrylate polymer, in any size, shape or color desired. Yet another object is to provide a lawn tablet which has its written information not subject to weathering.

A further object is to provide a lawn tablet which has therein indicia indicative to a person or the surroundings.

Hereafter the terms "lawn marker" and "lawn tablet" shall be utilized interchangeably, and such terms shall be utilized for markers employed in numerous environments for a multiplicity of purposes.

For example, the present marker can be used for memorial tablets, generally; for marking historic sites, commemorating historical events; and particularly as memorial tablets for use in lawn-type cemeteries. The marker can also be used for more functional purposes, such as curbside road markers; for indicating the names of streets; distance markers for highways; generally direction indicators; tee-hole numbers and yardage markers on golf courses, etc.

As noted above, such markers can be utilized in a vertical or horizontal position.

These and other objects and advantages of the invention will become more apparent from the following description and claims when taken in conjunction with the drawings, in which:

FIG. 4 is a perspective view of another marker of this invention, while

Figure 1:
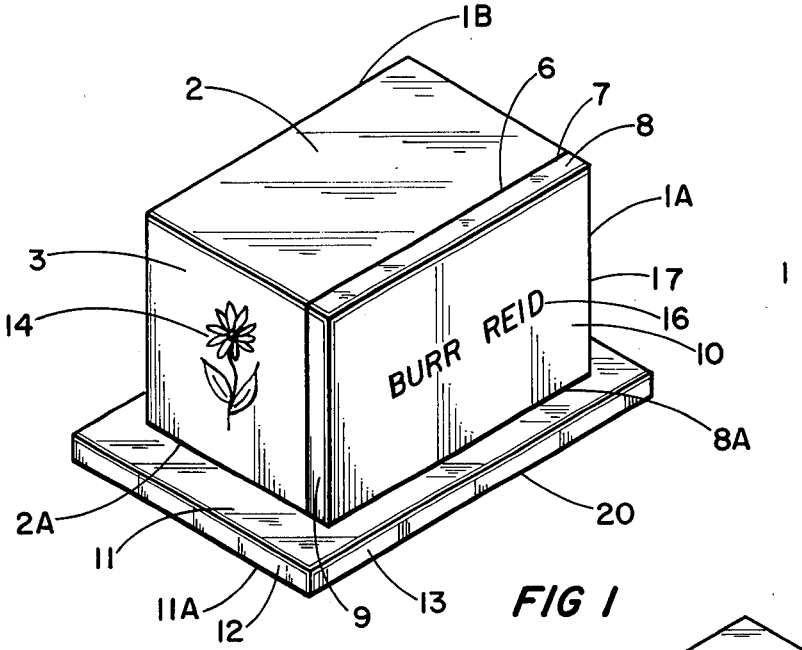
FIG. 1 is a perspective view of a lawn marker in a vertical positioning according to this invention.
Figure 2:
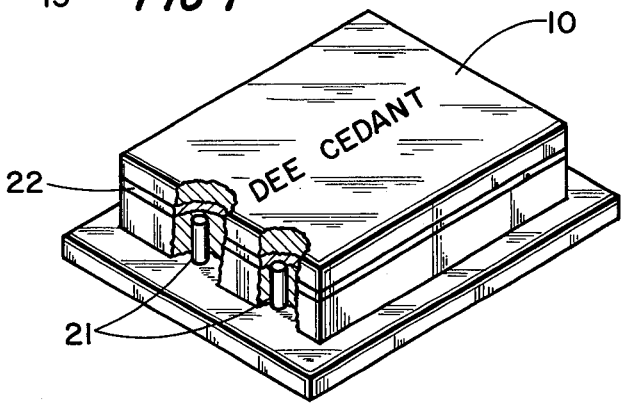
FIG. 2 is a perspective view of a lawn marker utilized in horizontal positioning.

As illustrated in FIGS. 1 and 2 wherein like numbers refer to like parts, there is provided a rectangular solid marker 1, composed of two parts: a rear part 1B and a front portion 1A positioned on a base number 20. Portion 1B includes an upper surface 2, two side surfaces 3 and 3 (not shown), a rear surface 5 not shown, a bottom surface 2A not shown, and a front surface 6. Surfaces 2, 3, 4 and 5 may be rough or smooth. Front surface 6, which is the interface with the front portion 1A, should have a substantially smooth surface. Surface 2A should also be substantially smooth. Portion 1B may be translucent at all surfaces or at least at one exterior surface.

The six surfaces are integral with each other along integral corner lines. Item 14 is an indicia desired to be enclosed by embedding it within the portion 1B during the manufacture thereof, as shall be described hereinafter. Typical items that can be embedded include the flower garden (14 shown in the drawing), religious medals, other jewelry, hobby items and the like, all of which are treasured mementos of a deceased person. Other items capable of being embedded include items indicative of the environment, such as golf tees or golf balls for a hole indicator sign; guns or records for battle monument signs; and flowers, fruits or berries for signs to be placed near trees or bushes in horticultural parks.

The front portion 1A is a solid also and has a plurality of surfaces and constitutes a mass of the same or different shape, and having one surface 7 coextensive, at least in part, with surface 6 of the rear portion. The front portion 1A, shown as a rectangular solid in FIG. 1, has a front face 10, side surfaces 9 and 15 not shown, a top 8 and a bottom 8A not shown. Item 16 designates information carried in the rear face and which is intended for viewing from the front surface 10. The front portion is usually placed in vertical and horizontal alignment with the rear part and adhered thereto. It is to be understood, however, that the configurations conceivable do not require the front and rear portions to be both or either horizontal or vertical alignment. The only requirement is that they are in superposed relationship, one to the other. The configuration overall may be as desired, so long as the viewing surface is in the same general plane as the carved surface panel such that viewing may be made with minimum distortion or effort.

The number 1 is shown being utilized in conjunction with a marker base number 20. Base 20 has four sides, 12, 13, 17 not shown, and 18 not shown, a top 11 and a bottom 11A not shown. Base 20 is formed from a heavy material such as concrete or stone and has a central opening therein, said opening being sized to receive one end of said marker 1. The marker is inserted therein so as to be held in either the upright or horizontal position, depending upon the style of the marker.

Typical bases that may be employed with the markers of this invention are those of Lauer, U.S. Pat. No. 3,383,787 and Hedges, U.S. Pat. No. 3,857,214. In the latter patent item 45 as shown in FIG. 1 and discussed at Col. 3, line 55, is exemplary.

Alternatively, when used without a base, earth should be dug away to a depth of 6 inches or so, the market set in place, and a few inches of dirt moved away around the girth of the marker. Concrete or other material is poured or otherwise placed in the excavated area up to the surface of the ground.

In some instances it may be desirable to have reinforcing rods extending up through the base and penetrating into the marker to provide a means of anchoring the marker to the base. Such rods are shown as number 21 in FIG. 2.

Figure 3:
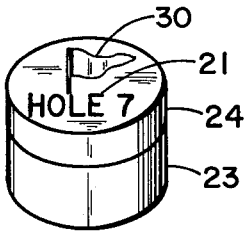
FIG. 3 is a perspective view of another horizontal embodiment according to the invention.

In FIGS. 2 and 3 the front face 10 is oriented 90° so as to become the top surface. In this mode, no part of 1A is positioned within the central opening of the base member. Thus, rather than surfaces 2A and 8A being set into the recessed portion of base number 20 in FIG. 2, surface 5 not shown is inserted therein.

In FIG. 2, layer 22 represents an acrylic sheet laminated between portions 1A and 1B. Details on this are recited elsewhere herein.

FIG. 3 depicts a marker 1 bearing the carved information 21, Hole 7, and embedded therein a small flag, 30. Such a marker is intended for use without a base, merely placed on or into a hole in the ground.

In FIG. 3 there is shown an upstanding circular side surface 24 of the front portion and an upstanding side surface 23 of the rear part, both shown to be in axial alignment with each other in a superposed relationship.

Figure 4:
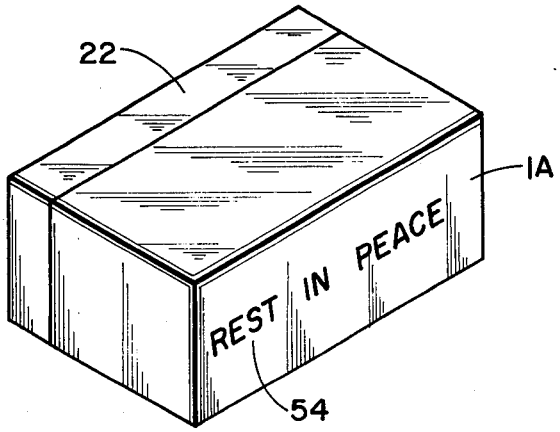

FIG. 4 depicts a marker in the format of a tombstone, without a base number and consisting solely of a front portion 1A and a laminating sheet 22. The laminating sheet can be any acrylic plastic or other plastic compatible with the acrylic of the front portion. Other materials, however, such as sheets of gold or silver, which may be capable of adhesion to the acrylic plastic without substantially affecting the optical qualities of the plastic, may be employed. The laminating sheet may be colored or colorless, translucent or opaque as is desired. Rest in Peace, 54, is rearcarved prior to lamination.

Figure 5:
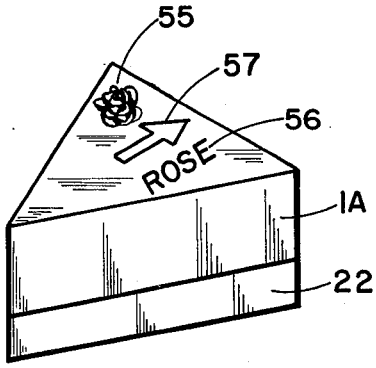
FIG. 5 depicts a similar marker positioned for top viewing.

The embodiment of FIG. 5 is a marker which can be used as a tombstone or direction indicator as in a botanical garden. It too is shown without a base and consists solely of a top portion 1A and a laminating sheet 22. As shown, the marker has embedded therein a flower 55 and a sign with the specie name 56 while the arrow 57 is carved in before the laminating sheet is applied.

The rear part 1B and the front portion 1A are cast as separate items, preferably of an acrylic resin. Such resins are polymers formed by the polymerization of esters of acrylic and methacrylic acid. In general, acrylic-type plastic contains about 90% methyl methacrylate and 10% of a copolymerizate of an ester of acrylic or methacrylic acid. The techniques for polymerizing the acrylic monomer is known to the art and will not be recited in detail other than as is necessary to explain the formation of the markers of this invention. Acrylic resins are readily available in the marketplace under such trademarks as Acrylite, Lucite and Plexiglas.

Prior to forming the markers of this invention, one must prepare a mold. Glass, metal, clay coated with gelatin, cellulose acetate and plaster of Paris coated with polyvinyl alcohol are all suitable mold materials, among others.

The preferred casting method comprises casting with a syrup which is a partially prepolymerized monomer available in the marketplace. If an inhibitor is present in the syrup it should be removed by known techniques.

The syrup is poured into the mold for the rear portion until a gel forms. The mold filled with syrup is placed in an oven or water bath at a temperature of about 180° to about 215° F and kept there for about two hours until the gel is formed. The gel stage polymerization can be hastened by increasing the temperature or by the addition of a catalyst, but one risks bubble formation by so doing.

The object(s) for embeddment are positioned in the desired location in the gel, and the mold is placed in an autoclave of the type used for the curing of plastics such as those manufactured by United Systems Corporation for polymerization to continue to conclusion. A vacuum is pulled and the air replaced by $CO_2$ or $N_2$ for safety. Precure polymerization is carried out under 35 to 150 P.S.I. of pressure.

To avoid bubbling, it is necessary to restrain polymerization to a rate that will permit the heat produced by the reaction to be dissipated as it is generated, or else one must take steps to prevent volatilization of the partial polymerizate by using a pressure sufficient to exceed the vapor pressure of the "monomer" at the highest temperature developed during the reaction.

The temperature is raised to 215° F (±5°) and the polymerization is carried on until the curing has taken place. For the average marker it has been determined that 10 hours is adequate. This calculates out to about 2 hours per one-half inch of thickness.

The autoclave is turned off after the predetermined time and allowed to gradually return to ambient temperature.

The embedded specimen is then removed from the autoclave, inspected for bubbles, fissures and cracks, and if inspection is passed, it is put back into the autoclave for annealing, which constitutes heating under vacuum at a temperature of 180°–190° F. Annealing time is the same as curing time. In the case of organic specimens which may be damaged at high temperatures, it may be necessary to heat treat at lower temperatures. Further to this point, it has been found in certain circumstances that longer time durations with lower temperatures should also be utilized in the curing step with selected embeddment specimens.

After removal from the autoclave the rear portion of the marker is ready for polishing as may be needed.

The front portion of the marker, or the top portion for those to be utilized vertically (FIG. 3 type), is prepared in the same general manner. Since no items are usually embedded in the front, slightly less care may be exercised, as the possibility of bubbling is reduced when no specimen is present.

The completed front portion, after polishing, is ready for carving. All carving is done from the rear, such that the viewer sees a smooth face, and this smooth face is what is presented to the elements. Carving tools for use with acrylics are known to the art. Typical are those manufactured by Dremel, who markets sets with internal engraving bits.

Upon completion of the carving, one or more suitable dyes is inserted into the carved areas as by brushing, spraying, dabbing, etc., to color these areas. Next, Plaster of Paris or other suitable putty is pushed into all carved areas in the amount necessary to fill the carved areas up to the outer periphery of the piece, i.e., up to the rear surface. This material soaks up excess dye and enhances the outward appearance of the marker by creating a 3-dimensional impression for the carved information.

Prior to curing, however, it is recommended that any necessary light sanding needed to remove imperfections not removable by buffing be carried out. The front and back portions are then laminated together using a suitable solvent such as ethylene dichloride and methylene chloride. However, it is preferred to use an interposed acrylic sheet, which is translucent, and which may be water white or dyed to the color of choice to better enable the details of the carving to be seen. Details of such lamination techniques are known to the art (See FIG. 2).

Anti-static coatings such as a dilute (0.5%) solution of a household detergent, may be applied if desired to the finished marker after all buffing is completed.

If for some reason the user does not desire a transparent appearance, any and all surfaces may be sanded to render them translucent. In addition, pigments can be added during processing to render either portion opaque as may be desired.

The markers of this invention may be utilized solely or in combination with a base. The base adds rigidity and weight and thus theft is hindered.

One base unit that can be employed with the markers of this invention when the markers are used as gravestones, constitutes a circumscribed mass of concrete. A hole about six inches deep and about six inches wider than the dimensions of the marker is dug. The marker is positioned in place and the hole is filled with concrete up to a height equal to the mowed grass level. If desired, a layer of concrete can be placed under the marker. Reference is made to U.S. Pat. No. 3,857,214 for a suitable base.

In addition, the markers of this invention can be utilized with the plastic enclosure for a concrete base, disclosed and claimed in U.S. Pat. No. 3,378,942 to Diamond.

For ease of alignment and visual beauty with rectangular solid markers, it is seen that the surface of the base and the total lower surface of the marker should be substantially flat. However, these surfaces need not be made flat throughout, so long as the portions thereof at their marginal edges lie in a substantially flat plane such that the total alignment can be as desired.

For markers of comparatively small size, it may be beneficial to employ a rigid prong positioned at right angles to the surface intended to lie on the ground. This prong can be threaded into the marker after the marker is tapped, or it may be glued into the marker after an opening of desired depth is drilled into the base of the marker. The prong would prevent the marker from being accidentally moved or removed.

It is seen that the difference between the several embodiments is as follows: Embodiment 1 of FIG. 1 constitutes two portions, namely, 1A and 1B, bonded directly together; whereas the embodiment of FIG. 2 employs an intervening interposed laminating sheet bonded between 1A and 1B. In FIG. 4, the embodiment constitutes only a front portion with a laminating sheet adhered thereto. FIG. 5 depicts an embodiment like that of FIG. 4.

It is also within the scope of this invention to both embed and carve in the same unit portion. Similarly, if embedment and carving are done in the same portion, the other portion can be free from carving or embedding.

At all times, however, the surface area of the laminating sheet is equal to the surface area of the front portion to which it is affixed, and said sheet's surface area is also equal to the surface of the rear part laminated thereto if such rear part is employed. The laminating acrylic sheet may be transparent or translucent, colored or colorless. A pleasing effect is obtained when the front or top portion is clear, and the sheet is colored.

Since certain changes may be made in the above apparatus without departing from the scope of the invention herein involved, it is intended that all matter contained in the above description and shown in the accompanying drawings shall be interpreted as illustrative and not in a limiting sense.

What is claimed is:

1. A marker for installation in a lawn or garden, comprising:

a. a solid first portion having at least one upstanding side wall, a top and a bottom surface, said portion having been formed by casting of an acrylic or methacrylic polymer in a mold, and having carved information areas therein, carved from one surface, said areas having a filling of a putty therein to aid in visually defining said areas and said carved and filled areas viewable from the surface opposite to and in the same general plane as the carved surface of said solid;

b. a solid second portion laminated on one side to the carved surface of said solid first portion and having a surface area on the side laminated at least equal to that of the surface of the front portion to which it is affixed;

wherein the combination of said (a) and (b) portion constitute the entire marker and further including indicia embedded in the first portion and viewable from the exterior of the marker.

2. The marker of claim 1, wherein the second portion is an acrylic sheet.

3. The marker of claim 2, wherein a rear plastic part is also laminated to the acrylic sheet, on the side opposite the laminated side, and which rear part has the surface area of the laminated surface equal to the area of the acrylic sheet.

4. The marker of claim 3, wherein indicia is embedded in the rear portion and is viewable externally.

5. The marker of claim 2, wherein the first solid portion is carved on its rear surface and the information is viewed from the front of said portion.

6. The marker of claim 2, wherein the information is carved on the bottom surface of the solid first portion and said information is viewed from the top surface.

7. The marker of claim 5, wherein a rear solid plastic part is also laminated to the acrylic sheet on the side thereof opposite the lamination to the front portion, the surface area of the laminated surface and the acrylic sheet being equal.

8. The marker of claim 7, wherein indicia is embedded in the rear part and is viewable externally.

9. The marker of claim 6, wherein a bottom solid plastic part is also laminated to the acrylic sheet on the side thereof opposite to the lamination to the top portion, the surface area of the laminated surface and the acrylic sheet being equal.

10. The marker of claim 9, wherein indicia is embedded in the bottom part and is viewable externally.

11. The marker of claim 1, wherein the laminated sheet is colored.

12. The marker of claim 7, wherein the laminated sheet is colored.

13. The marker of claim 9, wherein the laminated sheet is colored.

14. The marker of claim 8, further including a marker base upon which the marker rests.

15. The marker of claim 1, further including a marker base beneath said marker upon which the marker rests.

16. The marker of claim 1, wherein the putty is plaster of Paris.

17. The marker of claim 16, wherein the second portion is an acrylic sheet.

* * * * *